US007266335B2

(12) United States Patent
Van Den Berg et al.

(10) Patent No.: US 7,266,335 B2
(45) Date of Patent: Sep. 4, 2007

(54) METHOD OF PRINTING A RECEIVING MATERIAL, A PRINTER SUITABLE FOR CONDUCTING THIS METHOD, AND A METHOD OF ADJUSTING THE PRINTER

(75) Inventors: Roeland C. Van Den Berg, Eindhoven (NL); Cornelis W. M. Venner, Meijel (NL); Jacobus M. G. Eijssen, Tegelen (NL)

(73) Assignee: Oce-Technologies, B.V., Venlo (NL)

( * ) Notice: Subject to any disclaimer, the term of this patent is extended or adjusted under 35 U.S.C. 154(b) by 147 days.

(21) Appl. No.: 10/983,738

(22) Filed: Nov. 9, 2004

(65) Prior Publication Data

US 2005/0100370 A1 May 12, 2005

(30) Foreign Application Priority Data

Nov. 12, 2003 (NL) ..... 1024767

(51) Int. Cl.
*G03G 15/16* (2006.01)
*G03G 15/01* (2006.01)

(52) U.S. Cl. ..... 399/309; 399/301

(58) Field of Classification Search ..... 399/49, 399/301, 306, 309; 347/116, 129, 130
See application file for complete search history.

(56) References Cited

U.S. PATENT DOCUMENTS 5,394,223 A * 2/1995 Hart et al. ..... 347/116 X
5,886,728 A * 3/1999 Hamada et al. ..... 347/242
5,970,295 A 10/1999 Samizo
6,047,156 A 4/2000 De Bock
6,285,850 B1 * 9/2001 Van Weverberg et al. .. 399/309
6,321,060 B1 * 11/2001 Nakayasu et al. ..... 399/301
6,487,388 B2 * 11/2002 Theodoulou et al. ... 399/309 X

FOREIGN PATENT DOCUMENTS

EP 0 469 866 A 2/1992
EP 1 227 374 A 7/2002

OTHER PUBLICATIONS

Patent Abstracts of Japan, JP 09-274356, Oct. 21, 1997.

* cited by examiner

*Primary Examiner*—Sandra L. Brase
(74) *Attorney, Agent, or Firm*—Birch, Stewart, Kolasch & Birch, LLP

(57) ABSTRACT

A method of printing a receiving material wherein said receiving material is fed through a printer including a first and a second image-forming unit for substantially simultaneous printing of the front and back of said material in a transfer nip, whereby the two images are brought into register in the lateral direction with the receiving material by determining, prior to the formation of the images, a reference position at the transfer nip; forming the first image in such manner that part of said image which corresponds to the said reference position in the transfer nip substantially coincides therewith; and also forming the second image in such a manner that part of said image which corresponds to the said reference position in the transfer nip substantially coincides therewith; and feeding the receiving material to the transfer nip in such manner that that part of said material which corresponds to the reference position coincides substantially therewith at the transfer nip.

10 Claims, 6 Drawing Sheets

METHOD OF PRINTING A RECEIVING MATERIAL, A PRINTER SUITABLE FOR CONDUCTING THIS METHOD, AND A METHOD OF ADJUSTING THE PRINTER

This Nonprovisional application claims priority under 35 U.S.C. § 119(a) on Patent Application No(s). 1,024,767 filed in The Netherlands on Nov. 12, 2003, the entire contents of which are hereby incorporated by reference.

BACKGROUND OF THE INVENTION

The present invention relates to a method of printing a receiving material including the steps of feeding the receiving material through a printer containing a first and a second image-forming unit, each of the units containing a write head and an image medium. The method includes forming, by means of the first image-forming unit, a first image on the first image medium using the first write head; forming, by means of the second image-forming unit, a second image on the second image medium using the second write head, transferring, in a transfer nip, the first image to the front of the receiving material and the second image to the back of said material. The present invention also relates to a printer suitable for using the present including a method of adjusting the printer.

A method of this kind is known from U.S. Pat. No. 5,970,295. In this method, each of the image-forming units includes a write head for writing an electrostatic latent image on a photoconductive image medium and means for developing said image to form a visible image, using toner. The developed image is then transferred to an intermediate element in the form of an endless rubberized belt. The two intermediate elements of the image-forming units come together at the transfer nip. By feeding a sheet of receiving material through this transfer nip the front and back of the material can be printed substantially simultaneously. This gives the advantage that a sheet does not have to be turned over when it is required to be printed on both sides. As a result, the feeding of the receiving material is simplified and registration errors can be avoided or at least reduced. Minor register errors, however, can occur because the two image-forming units need not be identical. As a result, despite the fact that both images are written at the same time with the write heads, it may happen that one image reaches the transfer nip earlier than the other. A difference in head level, i.e. the position of an imaginary frame around a printed image with respect to the edge of the receiving material situated furthest downstream (also known as the leading edge), between the front and back of the receiving material is the result. A solution to this problem is known from the patent specification. How much time elapses between writing a latent image on the image medium and transferring the image formed therewith to the receiving material is determined by means of reference images for each of the image-forming units. If there is a difference in this time between the first and second image-forming units, then the time at which at least one of the printheads writes is adapted so that this difference is cancelled out. Another possibility is to adapt the speed at which the image media or intermediate elements revolve. Here again the difference in the time can be eliminated.

A disadvantage of the known method is that only registration deviations in the direction of transit of the receiving material can be remedied therewith. Adjustment of the writing time or a change of the speeds of revolution of the image-carrying media only gives possibilities for adjusting the position of an image on the receiving material in the direction of transit of the material. Although the registration errors that can be expected are probably more pronounced in this direction, the increasing demands made by users with respect to register quality means that even minor registration errors in a direction extending transversely to the direction of transit of the receiving material are found to be extremely disturbing.

For printers which use only one image-forming unit various solutions are known from the prior art to prevent registration errors in the lateral direction.

One solution proposes determining where the image is situated in the transfer nip, the sheet of receiving material being fed to the transfer nip in such a manner that it exactly coincides with the image. In this method, abbreviated as "image-sends-sheet," the sheet of receiving material is thus, in each case, sent to the corresponding image depending on where the image is situated in the transfer nip. In a printer with two image-forming units, use of this method results in good register of only one of the two images. A choice must then be made as to which of the two images is used to send the sheet. The position of the other image on the sheet of receiving material is then an uncertain outcome.

Another solution proposes measuring where the sheet of material is situated and so writing the image in dependence on the measurement in the lateral direction that the image coincides with the receiving material in the transfer nip ("sheet-sends-image"). This solution can in principle be successfully used in a printer with two image-forming units. However, since the instant of writing takes place long before the sheet of receiving material really is present in the transfer nip (the image must of course first be formed on the photoconductor, then transferred to an intermediate element and then transported to the transfer nip), the position of the receiving material in the transfer nip cannot yet be established with high accuracy at that specific writing instant. Consequently, it is practically impossible in this way to obtain very good register accuracy transversely of the direction of transit. Another disadvantage of this method is that deviations in the sheet transport may be relatively considerable, up to 10 mm deviation from the nominal (required) position. If such deviations have to be absorbed by adapting the image formation to these deviations, considerable tolerances are required for the image-forming units. This makes these units expensive and very bulky.

SUMMARY OF THE INVENTION

Accordingly, an object of the present invention is to provide a method which obviates the above described disadvantages. To this end, a method has been invented wherein two images are brought into register with the receiving material transversely to the direction of transit thereof. To obtain this registration, prior to the formation of the said images, a reference position is determined at the transfer nip; the receiving material is fed to the transfer nip in such manner that part of the material which corresponds to the reference position at the said nip substantially coincides therewith; the first image is formed on the first image medium in such manner that part of said image which corresponds to said reference position in the transfer nip substantially coincides therewith; and the second image is formed on the second image medium in such manner that part of said image which corresponds to the said reference position in the transfer nip substantially coincides therewith.

In the present method, therefore, a reference position in the transfer nip is determined and the two images and also the receiving material are fed to the transfer nip allowing for this reference position. A reference position can be selected in the center of the transfer nip, transversely to the direction of transit. In this embodiment, the receiving material is so fed to the transfer nip that the center of the material between the lateral sides coincides in the transfer nip with the center of the nip. The first image is then so formed that the center of this image, i.e. the center between the two (usually imaginary) lateral outline edges of said image in the transfer nip also coincides with the center of the nip. Thus the second image can also be formed in such manner that the center, considered in the lateral direction, of said image also coincides with the center of the nip. In this way, the corresponding parts of the two images and the receiving material coincide at the transfer nip, so that the images are brought into register with said material in the transverse direction.

In another embodiment, the receiving material is fed to the transfer nip in a manner comparable to the previous discussion, but just before the time that the two images are written, the lateral position of the sheet is measured. Using this instantaneous lateral position it is possible accurately to predict whether said sheet will exactly coincide with the reference position in the transfer nip or whether there will be a minor lateral deviation between the actual position and the predetermined reference position. If the latter is found, then no matter how small this deviation, it is possible to take it into account in the writing of the images. It is of course self-evident that another reference point, other than the center of the transfer nip, can be selected. The great advantage of the method according to the present invention is that lateral deviations due to the image formation can be compensated for without simultaneously having to take into account considerable lateral deviations in the transport of the receiving material. This provides many degrees of freedom and accordingly good register can be obtained with relatively simple means.

In one embodiment, wherein the write head includes a row of print elements which extends transversely of the direction of transit of the receiving material over a length at least equal to the length of the receiving material in said direction, the reference position is situated in a reference area laterally bounded by a first image line which forms at the transfer nip if a line is written with the nth element of the first write head and a second image line which forms at the transfer nip if a line is drawn with the $n^{th}$ element of the second write head.

In this embodiment, the write head is for example an LED printhead which contains an array of light-emitting diodes. In a printhead of this kind, which is sufficiently known from the prior art, each diode can be individually controlled and thus a latent image of high resolution can be written on a photoconductive image medium. In this embodiment, one arbitrarily chosen print element is selected from the two printheads, but in such a manner that print elements corresponding thereto are out of the arrays. If each write head comprises an array with 1000 print elements, the $500^{th}$ element, for example, of each write head could be selected. If one element is used to write a line on the image medium, then after development of this line an image line forms in a direction of transit of the printer. It should be noted here that depending upon the type of printer, the writing of a line takes place either by activating the corresponding print element (and deactivating the other print elements), or by deactivating the corresponding print element (and activating the other print elements). The former type is known as a "black writer" and the latter as a "white writer". The reference area now is laterally bounded in the transfer nip by two of the said image lines formed using the said corresponding ($n^{th}$) print elements. In the example selected, these are the two image lines formed by writing a line with every $500^{th}$ element of the write heads. It will be apparent that selecting the reference position in this area has the advantage that it is possible to use a narrower printer. By laterally centering the two image-forming units in the manner proposed, fewer tolerances have to be taken in the lateral direction. In this way it is possible to use write heads which extend only marginally outside the length of the largest format receiving material. Narrower printers are not only cheaper to manufacture but also have the advantage of a narrower floor area.

In another embodiment, wherein each write head has m print elements, n is equal to ½ m if m is an even number and n is equal to ½ m ±½ if an odd number. In this embodiment, the reference area is determined by substantially making with the center-most elements of each of the write heads the image lines which laterally bound the reference area in the transfer nip.

In one feature, the reference position corresponds substantially to the center of the reference area. This has the advantage that it is possible to use a very narrow printer because in this way both image-forming units are best centered laterally. In this way the reference position in fact coincides with the lateral center of the overlap area of the two image-forming units.

In another feature, the reference area is determined by printing a test pattern on the front and back of a reference receiving material, whereafter the mutual deviation in the lateral position of the center points of the test patterns is determined as is also the lateral position of at least one of the two test patterns with respect to the reference receiving material. This embodiment has the advantage of determining the reference area in very simple manner. By generating one and the same test pattern with corresponding print elements of two image-forming units, and then transferring the two test patterns to the front and back respectively of a reference receiving material (the "test print"), it is a simple matter to determine the mutual deviation in the lateral direction between the two image-forming units and the absolute position of one test pattern with respect to the reference receiving material. These data determine the position of the reference area as will be clear to the skilled man and also explained in the examples hereinafter.

In another embodiment, the printer automatically selects the reference position after inputting the said deviation and position by a user of the printer. In this embodiment, the user expects to input the mutual lateral deviation of the two test patterns and the position of one of the test patterns with respect to the reference receiving material, for example via the operator control panel of the printer. The printer can then readily determine the reference area, whereupon it is possible to make a choice of the reference position.

In one embodiment, the first image of the first image medium is transferred via a first intermediate element to the receiving material and the second image of the second image medium is transferred via a second intermediate element to the receiving material, with the transfer nip being formed by the two intermediate elements. This embodiment has the advantage that the image medium is not in direct contact with the receiving material in the transfer nip. Such contact is disadvantageous to the life of the image medium.

The present invention also relates to a printer for the duplex printing of a receiving material and a method of adjusting the printer accordingly.

BRIEF DESCRIPTION OF THE DRAWINGS

The present invention will now be explained in detail with reference to the following drawings, wherein.

DETAILED DESCRIPTION OF THE INVENTION

Figure 1:
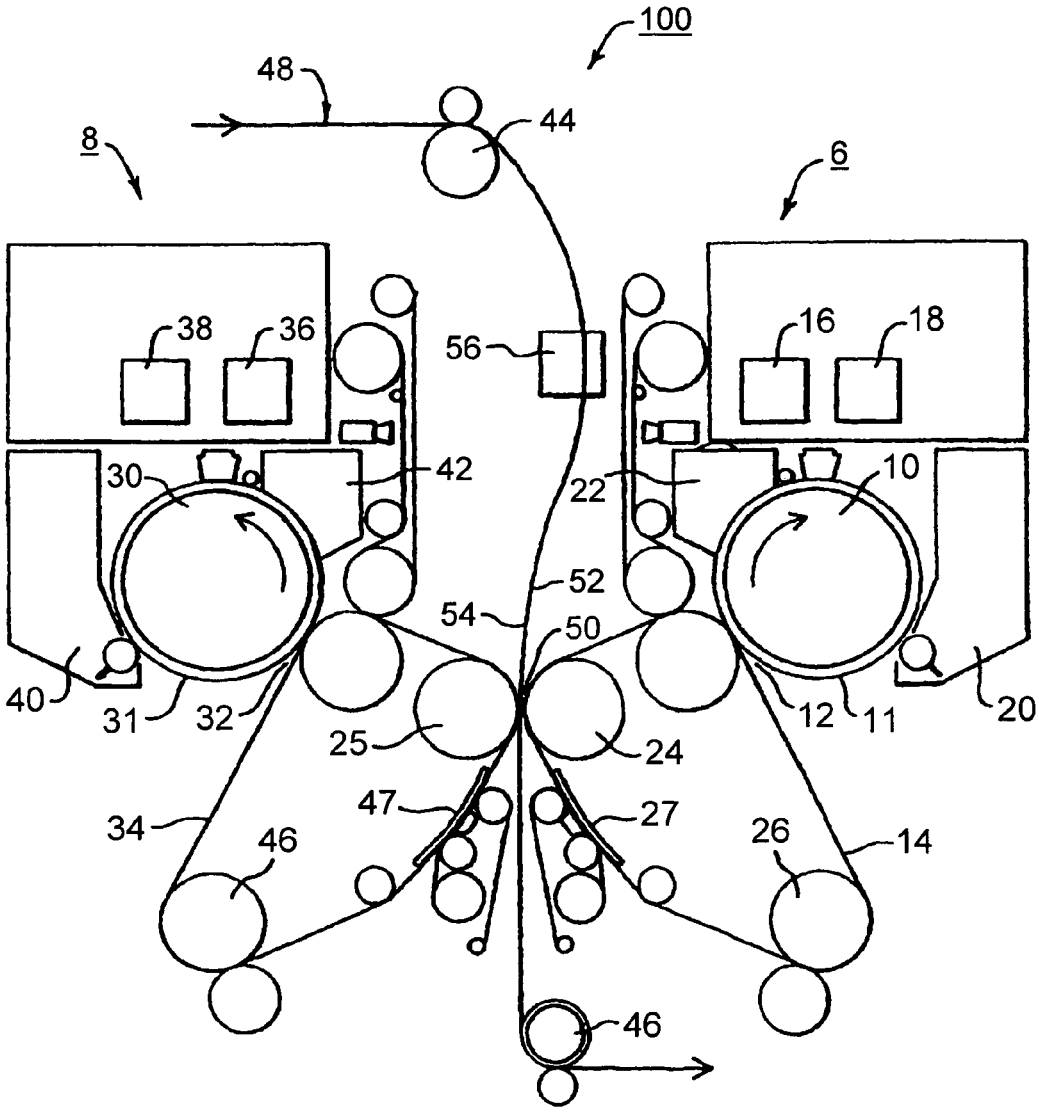
FIG. 1 diagrammatically indicates a printer provided with two image-forming units.

FIG. 1 diagrammatically illustrates a printer 100 comprising two image-forming units 6 and 8. This printer is known from U.S. Pat. No. 6,487,388. In this patent, is equipped to print an endless receiving material 48. To this end, the printer is equipped with tensioning elements 44 and 46. In another embodiment (not shown) the printer is adapted to print loose sheets of a receiving material. The image-forming units 6 and 8 can be used to form images on the respective front 52 and back 54 of the receiving material 48, which images are transferred to said material at the single transfer nip 50. Image-forming unit 6 comprises a write head 18 consisting of an array of individual print elements (not shown), in this embodiment an array of electron guns. By means of this write head it is possible to write a latent electrostatic charge image on the surface 11 of an image medium 10. This image is developed with toner located in developing station 20 or developing station 40 in connection with image-forming unit 8. To monitor this process, the medium is provided with various probes (not shown), particularly a probe for measuring the level of the charge of the surface and a probe for measuring the quantity of toner developed in those area where no image is written (known as "background" development"). By means of these probes it is possible to optimise the image-forming process. The visible toner image is transferred at a primary transfer nip 12 onto intermediate medium 14. This intermediate medium is a belt consisting of a silicone rubber carried by a fabric. Residues of toner located on the surface 11 are removed by means of cleaning station 22 and 42, whereafter the charge image is erased by means of erase element 16 and 36, respectively 16. Corresponding elements of image-forming unit 8 are indicated by the same reference numbers as the element of unit 6 but are increased by 20 units (as described in detail in the said patent specification). Thus the latent electrostatic charge image is written on surface 31 of image medium 30.

The images formed on the intermediate media 14 and 34 are transferred at transfer nip 50 on to the receiving material 48. For this purpose, the two intermediate media are printed on the receiving material by means of the pressure rollers 24 and 25, the images being transferred to material 48 under the influence of this pressure, heat and shearing stresses, and are at the same time fused thereto. For this purpose, the receiving material is preheated in station 56 and the intermediate media themselves are heated by heat sources located in rollers 24 and 25 (not shown). After transfer nip 50 the intermediate media are cooled in cooling station 27 and 47. The object of this is to prevent the intermediate media from becoming too hot at the primary transfer nips 12 and 32 respectively. When the printer is in the standby state, the temperature of the intermediate media is lower than necessary for a good transfuse step in nip 50. As is well known, when the next receiving material is to be printed, a signal will be transmitted to the heating elements in the rollers 24 and 25 in order to heat the corresponding intermediate medium. To be certain that the media are hot enough at the predetermined time of printing the first image, the time of giving the signal is made dependent on the loss of heat during the standby state. The greater this loss, the earlier the heating signal is given. If there is a changeover from a printing state to a standby state, the intermediate media are rapidly cooled to their standby temperature by means of cooling stations 27 and 47. As soon as the required temperature is reached the cooling stations are switched off so that they no longer extract heat from the intermediate media. The temperature control is then started again after a specific time so that the media retain a temperature substantially equal to a set temperature.

The image-forming units are disposed very accurately with respect to one another in a frame of the printer (not shown). In order to prevent the two units from perceptibly moving with respect to one another when the printer is exposed to external forces, for example torsion forces if the printer is on an uneven base, the two units 6 and 8 are suspended in a very stiff subframe. This subframe in front elevation extends vertically over part of the transport path of material 48 between the stations 44 and 46, and in the horizontal direction over the elements 16, 18, 36, 38 and 56. This T-shaped frame can be made stiff by mounting a T-shaped frame plate at the front of the image-forming units and mounting a comparable frame plate at the back of the image-forming units, the two frame plates being interconnected by cross-members. In this way a very rigid sub-frame is obtained, but with the image media and intermediate media still being easily accessible for carrying out servicing. This rigid sub-frame is carried by a main frame. A construction of this kind is known from EP 1,122,080, although in the present embodiment the sub-frame is not connected to the main frame but is simply placed freely on the main frame at three points of support. In this way the position of the sub-frame is statically determinate and forces which act on the main frame are not transmitted, or are rarely transmitted, to the sub-frame. In this way the mutual position of the two image-forming units is not disturbed. A signalling unit (not shown) is mounted at the outside of the frame so as to be visible to a user of the printer. Using this unit the user can, without viewing a display, see whether the printer has a problem so that he cannot print (malfunction, specific type of receiving material not in stock, finisher full, and so on) or that there are no problems.

As known from U.S. Pat. No. 5,970,295, the two images are brought into register with one another in the direction of transit of the receiving material 48, by monitoring the writing times of the two write heads 18 and 38 and also the speeds of revolution of image media 10 and 30, and the intermediate media 14 and 34.

In the embodiment illustrated, the intermediate media are driven via rollers 26 and 46. The speed of revolution of the intermediate media 14 and 34 is in this way controlled and kept equal. Image media 10 and 30 do not have their own drive facility and are driven by the mechanical contact with the intermediate media in the respective transfer nips 12 and 32. Since the two intermediate media and image media are never exactly equally long, the time elapsing between writing a latent image with write head 18 and transferring the corresponding toner image in the secondary transfer nip 50 will always be different from the time elapsing between writing a latent image with write head 38 and transferring the corresponding toner image in the secondary transfer nip 50. This difference in time can be compensated for by adapting the writing time of one or both write heads.

In another embodiment, the speeds of revolution of the two image media 10 and 30 are maintained exactly equal. This may be necessary if there is a joining of these image media, joining it is not possible to use the image media for generating an image. By arranging for the joining of the two image media to run exactly equally, i.e. the joints each pass the write heads 18 and 38, respectively, at exactly the same time, no additional image locations are lost. In this embodiment, in which the image media are also driven via intermediate media 14 and 34, the intermediate media will have different speeds from one another because there will always be a difference in length between the image media 10 and 30. This difference, together with other differences resulting in a difference in the above-mentioned time between writing an image and transferring the corresponding toner image to the receiving material, can again be compensated for by adapting and adjusting the writing time of one or both write heads.

Figure 2:
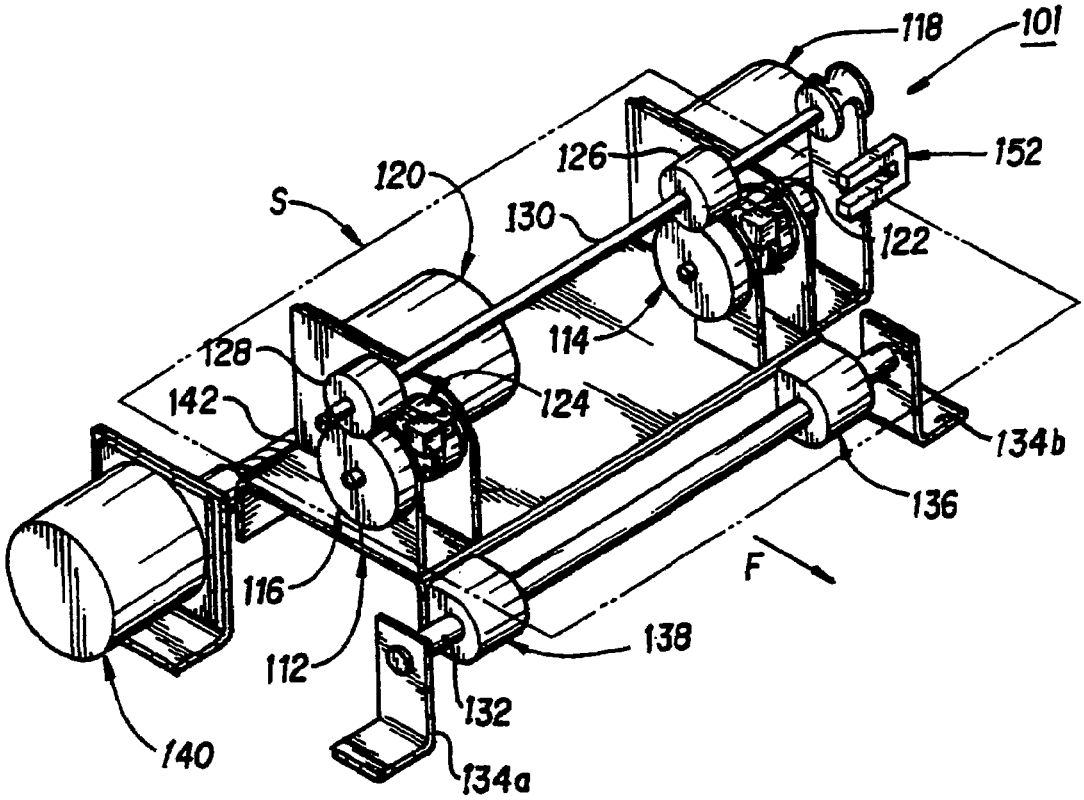
FIG. 2 shows an arrangement wherein a sheet of receiving material can be shifted in a lateral direction.

FIG. 2 shows an arrangement 101 with which it is possible to displace a sheet of receiving material in a lateral direction. An arrangement of this kind is known from U.S. Pat. No. 5,094,442. In this arrangement, a sheet of receiving material S is brought into register with the images for printing while said sheet is passed through the printer in the direction F as indicated. The registration device 101 comprises a carriage 112 comprising two drive rollers 114 and 116, which are rotatably mounted on the carriage and are driven by stepping motors 118 and 120. In this case the drive power is transmitted by belts 122 and 124.

Above the drive roller 114 there is mounted a backing roller 126 which forms a nip with roller 114. A comparable roller 128 is mounted above roller 116. The two backing rollers are mounted on a shaft 130 which is mounted on the carriage 112. In one embodiment, the drive rollers are constructed as relatively wide aluminium rollers (about 15 mm wide) provided with a somewhat rough tungsten carbide coating. The backing rollers are relatively narrow (4 mm) aluminium rollers provided with a hard silicone rubber top layer (hardness 80 Shore A). The sheet S is received by the nips and fed through the registration device 101. The tungsten carbide coating ensures a good grip on the sheet and the narrow nip makes the sheet relatively easy to feed at an angle with the direction F.

For the lateral displacement of the sheet S the carriage 112 is transversely movable. This transverse movement is possible because an edge of the carriage (112) is fixed on guide 132 which extends perpendicularly to the direction of transit F of the sheet S. Guide 132 is supported by the frame on which device 101 is fixed by means of pair of opposite fixing brackets 134*a* and 134*b*. The carriage 112 is placed on the guide 132 by means of friction bearings 136 and 138. The device further comprises a sensor 152 by means of which it is possible to determine the lateral position of the sheet S. If this position deviates from the required position, the carriage can be moved laterally with respect to the brackets 134 by means of motor 140 and screw spindle 142. Since the sheet S is gripped in the nips formed by the pairs of rollers 114-126 and 116-128, the sheet will be moved laterally together with the carriage 112. In this way it is possible to bring a sheet S laterally into the required position.

Figure 3A:
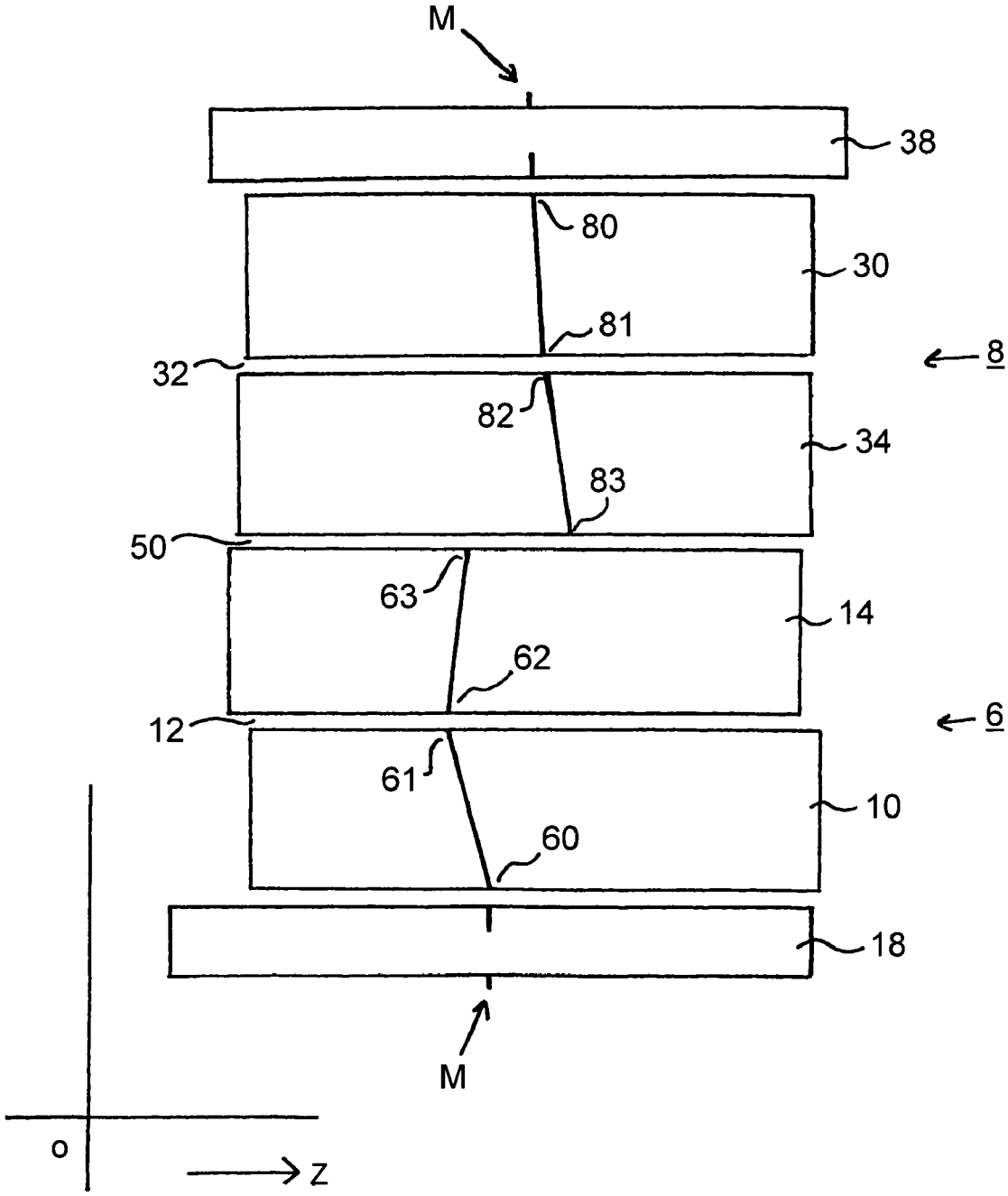
FIGS. 3A and 3B are diagrams showing a top plan view of the two image-forming units.
Figure 3B:
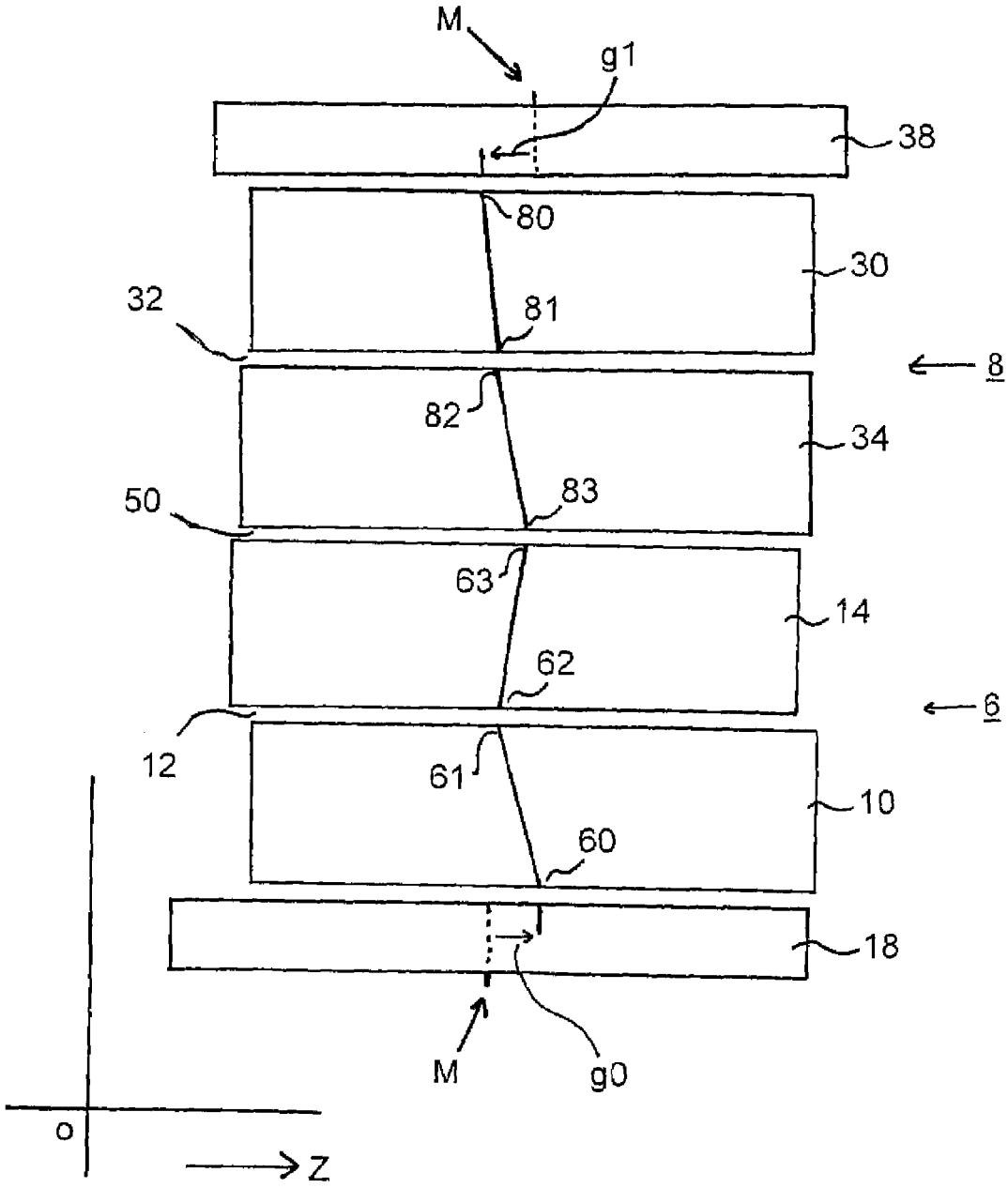

FIG. 3, made up of FIGS. 3A and 3B, diagrammatically shows a top plan view of two image-forming units. In FIG. 3A, the write head 18, image medium 10 and intermediate medium 14 of image-forming units 6 are shown in top plan view, together with the corresponding elements 38, 30 and 34 of image-forming unit 8. The primary transfer nips 12 and 32, and the secondary transfer nip 50 are also indicated. The elements shown extend in the lateral direction indicated by Z. The physical centers of the two write heads are marked and indicated by the letter M. In practice, the two write heads will never have exactly the same position in the lateral direction. In addition, an image point formed at a specific lateral position on a write head will also be laterally displaced (g0,g1) during the transport of the image from the writing position (indicated by reference 60 and 80 respectively) via the image medium and intermediate medium to the secondary transfer nip. The example illustrated shows for each image-forming unit, where art image point is situated in the transfer nip, if said image point is written by a printing element situated level with the physical centers of a write head. The image point written with write head 18 on image medium 10 at location 60 experiences, during development and transport to the primary transfer nip 12 (location 61), a negative lateral shift. After the image has been transferred (location 62) to the intermediate medium, the image is transported to the transfer nip 50 (location 63). In this example the image in these conditions experiences a slightly positive lateral shift. Comparable shifts are experienced by an image point written with the second write head 38. The following table shows the exact position of the image point at each transitional location in the lateral direction.

TABLE 1

Lateral position of image points written with the center of write heads at different locations

| Location | Z position, image-forming unit 6 | Z position, image-forming unit 8 | ΔZ |
|---|---|---|---|
| Write head | 180 mm | 185 mm | 5 mm |
| Primary transfer | 174 mm | 187 mm | 13 mm |
| Secondary transfer | 177 mm | 191 mm | 14 mm |

This table gives the lateral position in millimeters from the zero position as indicated in the drawing (the absolute value of the deviations are much narrower in practice). It will be seen that the write heads themselves have a mutual deviation of 5 mm in lateral positioning. In addition there is a shift of the images during the transport to the transfer nip 50. The result is that two image points initially formed at the physical centers of each of the write heads finally have a mutual lateral deviation in the transfer nip equal to 14 mm. Since the images are transferred to the receiving material in the transfer nip 50, it is this deviation which will finally be visible to the printer user.

According to the present invention, this problem can be obviated by determining a reference position at the transfer nip 50. In this example, the center between the two image points is taken as the lateral reference position.

$$\text{Reference position}=(177+191)/2=184\text{ mm} \qquad \text{(formula 1)}$$

This reference position is the place that should be reached by the center of the images as initially formed by the two write heads. Thus, according to the present invention those images will now have to be so written with the said write heads that the centers of these images correspond substantially to the reference position at the transfer nip. For this purpose, as indicated in FIG. 3B by reference 90, the center of an image using the write head 18 will have to be written with the print element situated +7 mm (=184−177) away from the physical center of said write head. Viewed laterally, this element is located at 180+7=187 mm from the zero line. For write head 38 the center of an image must continue to be written with the print element situated −7 mm (=184−191) from the physical center of said write head (indicated by number 91 in FIG. 3B). Viewed laterally this element is situated at 185−7=178 mm from the zero line.

FIG. 3B shows that an image point written with write head 18 at location 60 now shifts, via locations 61, 62 and 63, to the reference position at the transfer nip. An image point written with write head 38 will also shift at location 80, via location 81, 82 and 83, to the same reference position. In this way the centers of the two images, and hence the entire images, will be brought into register with one another at least in the lateral direction. In table 2, the absolute values of the lateral positions of the image points for the example of FIG. 3B are given.

TABLE 2

Lateral position of image points written with the center of the write heads at different locations using the method according to the present invention.

| Location | Z position, image-forming unit 6 | Z position, image-forming unit 8 | ΔZ |
|---|---|---|---|
| Write head | 187 mm | 178 mm | −9 mm |
| Primary transfer | 181 mm | 180 mm | −1 mm |
| Secondary transfer | 184 mm | 184 mm | 0 mm |

As will be apparent from the table, the difference in lateral position between the two image points at the secondary transfer nip is zero. The reference position is also used to bring the receiving material into register with the two images. In this example, the reference position coincides with the center of the images required to be printed at the front and back. Thus the lateral center of the receiving material at the transfer nip should also coincide with the reference position. The device as shown in FIG. 2 can be used for this purpose.

Figure 4A:
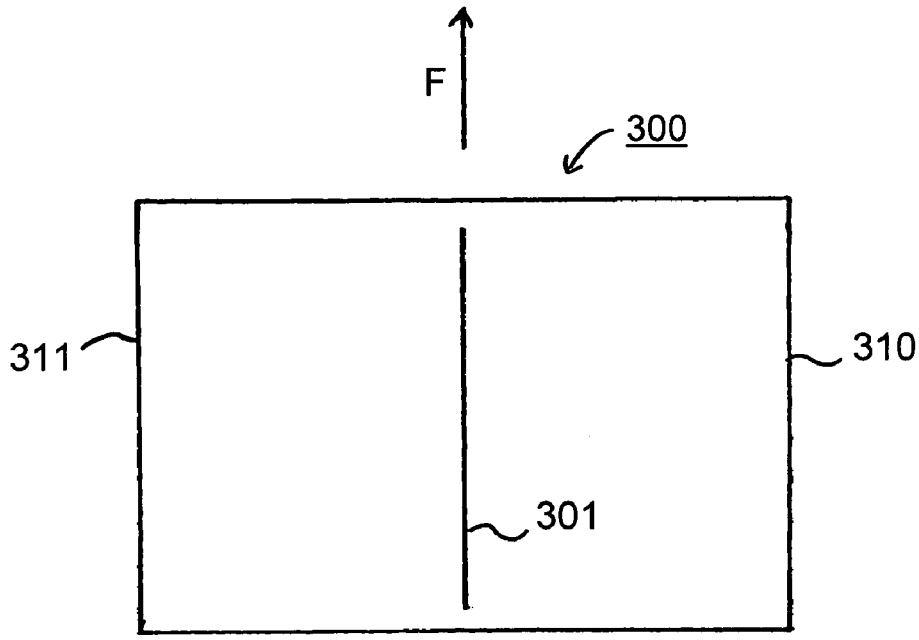
FIGS. 4A and 4B are diagrams showing a reference receiving material and test pattern.

FIG. 4 diagrammatically shows a reference receiving material and test pattern. FIG. 4A shows a reference receiving material 300 that can be used to determine the lateral deviations in image formation and receiving material transport (as described in connection with FIG. 3). By means of these data it is then possible to determine a reference position for use according to the present invention. In this embodiment the reference receiving material 300 is a sheet of white paper which is semi-transparent (60 g/m$^2$ paper) and which is provided with a reference line 301. The latter is situated centrally between the lateral sides 310 and 311. This reference material is suitable for feeding through a printer in the direction F indicated. A frequently occurring standard receiving material could also be selected as reference material for example, white 80 g paper of A4 format, in which a reference line is provided by folding the material. The fold itself then serves as the reference line.

Figure 4B:
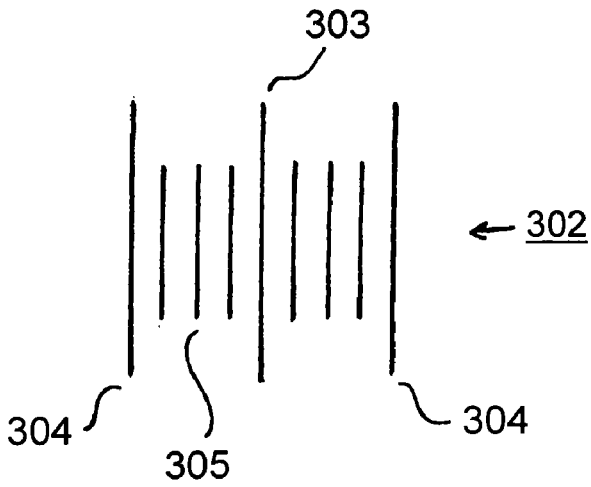

FIG. 4B shows a test pattern 302. This test pattern consists of a center line 303, side lines 304 and intermediate lines 305. The distance between the lines is, in each case, 0.5 mm so that the lines can be very easily seen with the naked eye when this pattern is printed on the receiving material. In this embodiment, the print elements on the write head are mounted with a resolution of 610 elements per inch (610 d.p.i.). Since the resolution of the print elements is equal to the resolution of the image (in the printer according to the embodiment the print elements are of course imaged directly on the image medium without the intervention of a lens), the distance of 0.5 mm between each line coincides with the distance between 12 print elements of the write head.

To determine the reference position, the test pattern 302 is printed on the front and back of the reference receiving material 300 in such manner that to form the center line 303, there is selected in each case that print element which coincides with the physical center point of the array of print elements of the write head. The reference receiving material is in this case fed to a known lateral position in the transfer nip. A reference receiving material printed in this way is shown diagrammatically in FIG. 5.

Figure 5:
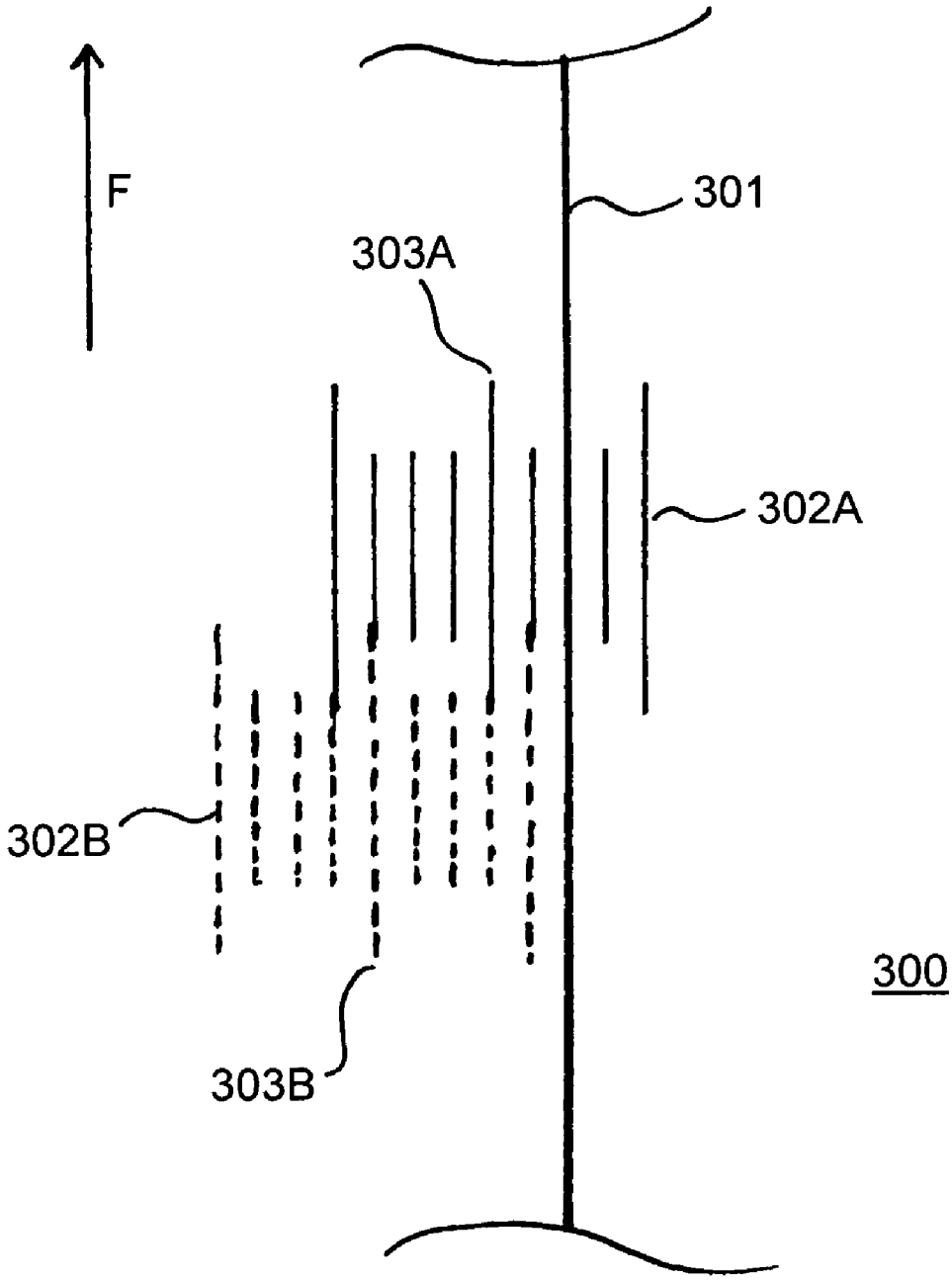
FIG. 5 is a diagram showing the reference receiving material printed with the test pattern on the front and back.

FIG. 5 diagrammatically illustrates the reference receiving material 300 printed with the test pattern 302 on the front and back. A restricted area of the reference receiving material 300 is shown, namely an area containing part of the reference line 301. The front of the material 300 on which test pattern 302A is printed is shown in elevation. Visible are center lines 303A, side lines and intermediate lines. The test pattern 302B is printed on the back of the material. Since material 300 is to some extent transparent, test pattern 302B can be viewed from the front of said material. This is shown diagrammatically by the broken lines illustrating the pattern in the drawing. This pattern is also shifted somewhat in the direction of transit F in order to make second said test pattern more visible in the drawing. It will be seen that the two test patterns have a mutual deviation in the lateral direction, transversely of the direction of transit F. The possible reason for this deviation is given in connection with FIG. 3A. The lateral difference in this example is virtually equal to three units, i.e. three times the distance between two lines of the test pattern, i.e. approximately 1.5 mm. Similarly to the example in connection with FIG. 3B, the reference position selected in the transfer nip can be the center between the two lines 303A and 303B. From this it follows that at write head 18 used to write test pattern 302A the print element 0.75 mm on the left of the physical center of this write head (corresponding to about 18 print elements) should continue to be used for writing the lateral center of an image. With regard to write head 38 this means that the print element situated 0.75 mm on the right of the physical center of this write head should continue to be used for writing the lateral center of an image.

It will also be seen that the reference line 301 does not coincide with the center between the two center lines 303A and 303B. The lateral deviation is about 3½ units, i.e. 1.75 mm. This means that a following sheet of receiving material must be shifted 1.75 mm further to the left than the reference receiving material in the above described test. The physical center of a sheet of this kind will then substantially coincide with the reference position at the transfer nip.

In this way, both the images mutually, and the images with respect to the receiving material, are brought laterally into register with one another. In practice, a person adjusting the printer will carry out the above described test. It is he who then measures the difference in the lateral position of the two test patterns. He will also at least determine the lateral deviation between the reference line 301 and one of the two center lines 303. By introducing the values of these deviations, for example in measured units (=lateral distance between two lines of the test pattern), the printer can then automatically determine how to adapt the formation of the images with the write heads and the transportation of the receiving material in such manner as to obtain good lateral registration. Use of the method according to the present invention does not mean that the reference position at the transfer nip is explicitly known (for example by calculation). What is the case is that, for example, by initial measurement of the lateral deviations and adaptation of the image formation as indicated in connection with FIGS. 3B and 4, this reference position is clearly established and hence determined. Other methods than those described in the examples can also result in a lateral registration according to the present invention without the reference position in the transfer nip being explicitly known, provided that said position is clearly established in said nip on the basis of the method followed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of printing a receiving material by feeding the receiving material through a printer containing a first and a second image-forming unit, each of the units including a write head and an image medium, the method comprising forming, by means of the first image-forming unit, a first image on the first image medium using the first write head, forming, by means of the second image-forming unit, a second image on the second image medium using the second write head, transferring, in a transfer nip, the first image to the front of the receiving material and the second image to the back of the receiving material, the two images being brought into register with the receiving material, transversely of the direction of transit thereof, wherein, to obtain said registration:

prior to the formation of the said images, a reference position is determined at the transfer nip, the receiving material is fed to the transfer nip in such manner that part of said material which corresponds to the reference position at the said nip substantially coincides therewith, the first image is formed on the first image medium in such manner that part of said image which corresponds to said reference position in the transfer nip substantially coincides therewith, and the second image is formed on the second image medium in such manner that part of said image which corresponds to the said reference position in the transfer nip substantially coincides therewith.

2. The method according to claim 1, wherein the write head comprises an array of print elements which extends transversely of the direction of transit of the receiving material over a length at least equal to the length of the receiving material in said direction, wherein the reference position is situated in a reference area laterally bounded by a first image line which forms at the transfer nip if a line is written with the nth element of the first write head and a second image line which forms at the transfer nip if a line is drawn with the nth element of the second write head.

3. The method according to claim 2, wherein each write head has m print elements, and n is equal to ½ m if m is an even number and n is equal to ½ m±½ if m is an odd number.

4. The method according to claim 2, wherein the reference position corresponds substantially to the center of the reference area.

5. The method according to claim 2, wherein the reference area is determined by printing a test pattern on the front and back of a reference receiving material, whereafter the mutual deviation in the lateral position of the center points of the test patterns is determined as is also the lateral position of at least one of the two test patterns with respect to the reference receiving material.

6. The method according to claim 5, wherein the printer automatically selects the reference position after inputting of the said deviation and position by a user of the printer.

7. The method according to claim 1, wherein the first image of the first image medium is transferred via a first intermediate element to the receiving material and the second image of the second image medium is transferred via a second intermediate element to the receiving material, the transfer nip being formed by the two intermediate elements.

8. A printer for the duplex printing of a receiving material, including a first and a second image-forming unit, wherein each unit contains a write head and an image medium, by means of which write head an image can be formed on the image medium, and a transfer nip for substantially simultaneously transferring a first image to the front of the receiving material and the second image to the back of said material, wherein the printer comprises control means for determining, prior to the formation of the said images, a reference position at the transfer nip; for so controlling the first write head that the first image is so formed that part of said image which corresponds to the said reference position in the transfer nip coincides substantially therewith; for so controlling the said second write head that the second image is so formed that part of said image which corresponds to the said reference position in the transfer nip substantially coincides therewith; and for feeding a receiving material to the transfer nip in such manner that part of said material which corresponds to the reference position at the transfer nip substantially coincides therewith, the first and second images being brought into register with the receiving material transversely of the direction of transit of the receiving material.

9. A method of adjusting a printer for the duplex printing of a receiving material comprising a first and a second image-forming unit, each unit comprising a write head and an image medium, by means of which write head an image can be formed on the image medium, the printer further including a transfer nip for substantially, simultaneous transferring a first image to the front of the receiving material and the second image to the back of said material, the two images being brought into register with the receiving material, transversely of the direction of transit of the receiving material, wherein prior to the formation of the said images a reference position is determined at the transfer nip for bringing the two images into register with the receiving material by printing a test pattern at the front and back of a reference receiving material.

10. The method according to claim 9, wherein mutual deviation in the lateral position of the test patterns, considered with respect to the direction of transit of the receiving material through the printer, is determined, as well as the absolute position of at least one of the two test patterns on the reference receiving material.

* * * * *